US007736179B2

(12) United States Patent
Cook et al.

(10) Patent No.: US 7,736,179 B2
(45) Date of Patent: Jun. 15, 2010

(54) REFRIGERATOR WITH PLUG-IN POWER SUPPLY

(75) Inventors: Lori Ann Cook, Evansville, IN (US); Ronald Wayne Guess, Evansville, IN (US); Douglas David Leclear, Benton Harbor, MI (US); Frank Weston Maglinger, Evansville, IN (US); Patrick S. Streeter, Evansville, IN (US); Ralph Tate, Jr., Evansville, IN (US); Andrew Michael Tenbarge, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 122 days.

(21) Appl. No.: 12/193,377

(22) Filed: Aug. 18, 2008

(65) Prior Publication Data

US 2009/0064702 A1 Mar. 12, 2009

Related U.S. Application Data

(60) Provisional application No. 60/960,038, filed on Sep. 12, 2007.

(51) Int. Cl.
*H01R 33/945* (2006.01)

(52) U.S. Cl. ..... 439/577; 439/929; 439/95

(58) Field of Classification Search ..... 439/577, 439/248, 206, 929, 95; 320/115, 113
See application file for complete search history.

(56) References Cited

U.S. PATENT DOCUMENTS

| | | | | |
|---|---|---|---|---|
| 4,308,724 | A | 1/1982 | La Ginestra | |
| 4,578,902 | A | 4/1986 | Niekrasz et al. | |
| 5,248,196 | A | 9/1993 | Lynn et al. | |
| 5,577,823 | A * | 11/1996 | Maglinger | 312/404 |
| 6,777,654 | B1 | 8/2004 | Greenburg | |
| 2004/0216471 | A1 | 11/2004 | Kim et al. | |
| 2005/0138948 | A1 | 6/2005 | Lee | |
| 2005/0138949 | A1 | 6/2005 | Jang et al. | |
| 2006/0145576 | A1 | 7/2006 | Lee et al. | |
| 2006/0217600 | A1 | 9/2006 | Lee et al. | |
| 2007/0056306 | A1 | 3/2007 | Trulaske et al. | |
| 2009/0064702 | A1 * | 3/2009 | Cook et al. | 62/331 |
| 2009/0064705 | A1 * | 3/2009 | Maglinger | 62/377 |
| 2009/0311896 | A1 * | 12/2009 | Myer et al. | 439/248 |

* cited by examiner

*Primary Examiner*—T C Patel
*Assistant Examiner*—Phuong Nguyen

(57) ABSTRACT

A plug-in power supply for a refrigerator used to charge portable electronic devices includes an auxiliary power supply mounted in an auxiliary power supply compartment, and a removable module, having an electrical connector, mounted in an electrical connector cup. A portable electronic device is charged by placing the device in the connector cup and coupling the device to the electrical connector. Power is then supplied from the auxiliary power supply to the portable electronic device.

19 Claims, 4 Drawing Sheets

REFRIGERATOR WITH PLUG-IN POWER SUPPLY

CROSS-REFERENCE TO RELATED APPLICATION

The present invention claims the benefit of U.S. Provisional Patent Application Ser. Nos. 60/960,038 entitled "Refrigerator with Plug-In Power Supply", filed Sep. 12, 2007.

BACKGROUND OF THE INVENTION

1. Field of the Invention

The present invention pertains to the art of refrigerators and, more particularly, to providing an auxiliary power connector on a refrigerator to enable a variety of portable electronic devices to be electrically connected to and powered through the refrigerator.

2. Description of the Related Art

A typical domestic refrigerator runs on a predetermined power supply, e.g. a 120 volt supply in the United States, for operating various components including the overall refrigeration system, lights, an icemaker and the like. Generally, a domestic refrigerator is provided with a single plug that is coupled to an electrical socket or outlet arranged behind the refrigerator upon initial installation of the refrigerator in a household kitchen. Due to the location of the electrical outlet, it is generally inaccessible for use with other electrical devices. Instead, consumers rely upon the existence of other electrical outlets arranged at other locations spaced from the refrigerator about the kitchen for powering the other electrical devices.

It has been proposed in the past to provide a domestic refrigerator with an auxiliary electrical outlet that could be utilized for powering an electrical device, such as a lamp, directly from the refrigerator. For example, U.S. Pat. No. 4,308,724 discloses the mounting of an electrical outlet on the side of a refrigerator and plugging a lamp into the outlet. The electrical outlet is actually connected in parallel to a component of the refrigeration system such that the outlet is powered only when the refrigeration component is powered. Other proposed arrangements directly incorporate another electrical device into a refrigerator, such as a portable computer, TV or audio unit, with each of these devices being provided with a dedicated power line taken from the main refrigerator supply.

In modern society, individuals typically own various portable electronic devices having different power requirements and distinct power connectors. For example, cell phones and portable music players are extremely popular. These and other similar devices have integrated batteries which need to be periodically charged. For this reason, these devices are generally provided with individualized power charging cords and associated transformers. Since it is not convenient to carry these various power charging cords around, people tend to leave the charging cords in a predetermined location, such as at a nightstand or bedroom dresser, and periodically charge the devices from this location. Unfortunately, this arrangement is not always convenient.

SUMMARY OF THE INVENTION

The present invention is directed to expanding the ability of individuals to conveniently power portable electronic devices from different locations. More specifically, the invention is concerned with providing an auxiliary power connector unit on a refrigerator to enable a variety of portable electronic devices, including cell phones, personal music players like iPods, as well as digital picture frames, Web tablets, message boards, TV's, CD and/or DVD players, and the like to be electrically connected to and powered through the refrigerator.

In accordance with a preferred embodiment of the invention, an electrical connector cup is mounted, preferably in a recessed manner, to either a door or cabinet shell portion of the refrigerator. A preferred location is atop a door of the refrigerator, with the connector cup having an open top which exposes an interior of the cup. Within the cup is mounted at least one electrical connector designed for use with one or more portable electronic devices owned by a particular individual. The electrical connector is provided as part of a module selected for use with the portable electronic device(s) of interest. Therefore, dedicated modules would be available and readily replaceably mounted in the connector cup, with each module have one common connector side for interconnecting the connector with an auxiliary power supply and an exposed, dedicated connector side for selective attachment to the portable electronic device(s).

As different portable electronic devices will have different voltage and power requirements, each replaceable module would have a related auxiliary power supply which can also be replaced. However, to make the connection arrangement more universal, an embodiment of the invention provides an auxiliary power supply designed to power a desired portable electronic device having a rather high power rating, while the module employed actually incorporates multiple electrical connectors, such as pin arrays, which can accommodate the attachment of multiple portable electronic devices. In conjunction with this embodiment, various taps lead from the auxiliary power supply to the individual electrical connectors. In the alternative, multiple auxiliary power supplies could be employed, while being preferably linked to a common module. In accordance with the invention, the auxiliary power supply can be housed at various locations on the refrigerator, including adjacent the connector cup, at a water/ice dispenser unit and behind the lower front grill. The structure covering the auxiliary power supply can be linked such that opening or removal of the cover would disable power to the power supply. Although other locations within the cabinet of the refrigerator could also be employed, these supply compartment locations are preferred due to the ease of routing wires under the cabinet and within the door, particularly given that many refrigerators already have wires routed through these locations, such as to accommodate ice/water dispenser requirements.

When the preferred embodiment of an exposed electrical connector cup is utilized, it is desired to maintain the connector module above a bottom of the cup and to provide a passage for draining the cup of any entering liquids, such as spilled liquids. In one preferred embodiment, the module includes a mounting plate through which the connector projects. The mounting plate is secured to a central, raised portion of the connector cup through the use of mechanical fasteners extending into mounting posts of the cup. Preferably, the cup is integrally molded of plastic and includes a lower drain opening. Although a separate conduit could be provided, in the most preferred embodiment wherein the connector cup is provided atop a door of the refrigerator, the same conduit within which the wires are routed to the electrical connector(s) is exposed to the drain opening, with the conduit leading to a drip pan provided below the refrigerator cabinet to provide the desired passageway for draining of the connector cup.

To enhance the ease of which one or more portable electronic devices can be connected at the module and to prevent undesirable damage to the pins or other connectors of the module, the connector is designed to be shiftable or float relative to the connector cup. In the preferred embodiment wherein a mounting plate is employed, the hole(s) through which the electrical connector extends is enlarged, thereby permitted a relative degree of shifting between these members. If the electrical connector is directly mounted to the connector cup, oversized mounting holes are provided and used to loosely attach the connector to the cup, such as with shoulder screws. Therefore, accommodations are made in the mounting of the module to provide for a tolerance variation in order to minimize any binding, bending or other damaging effects on the connector.

Based on the above, it should be readily apparent that the present invention enables a wide range of portable electronic devices to be directed attached to and powered through a refrigerator. For instance, the refrigerator can now be used as a cell phone charging location, as well as a hands-free speaking station. Portable music players can be readily attached to the refrigerator for charging purposes. In addition, speakers can be linked to the station for earphone-free listening of stored music. Accommodations are made for customizing the necessary electrical connections and power requirements based on the devices owned by the particular consumer. In addition, in the case of an exposed electrical cup, provisions are made to assure that liquids cannot accumulate therein. Furthermore, various mounting considerations have been addressed which enables the convenient use of dedicated modules, while preventing undue damage to the connector structure during use.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
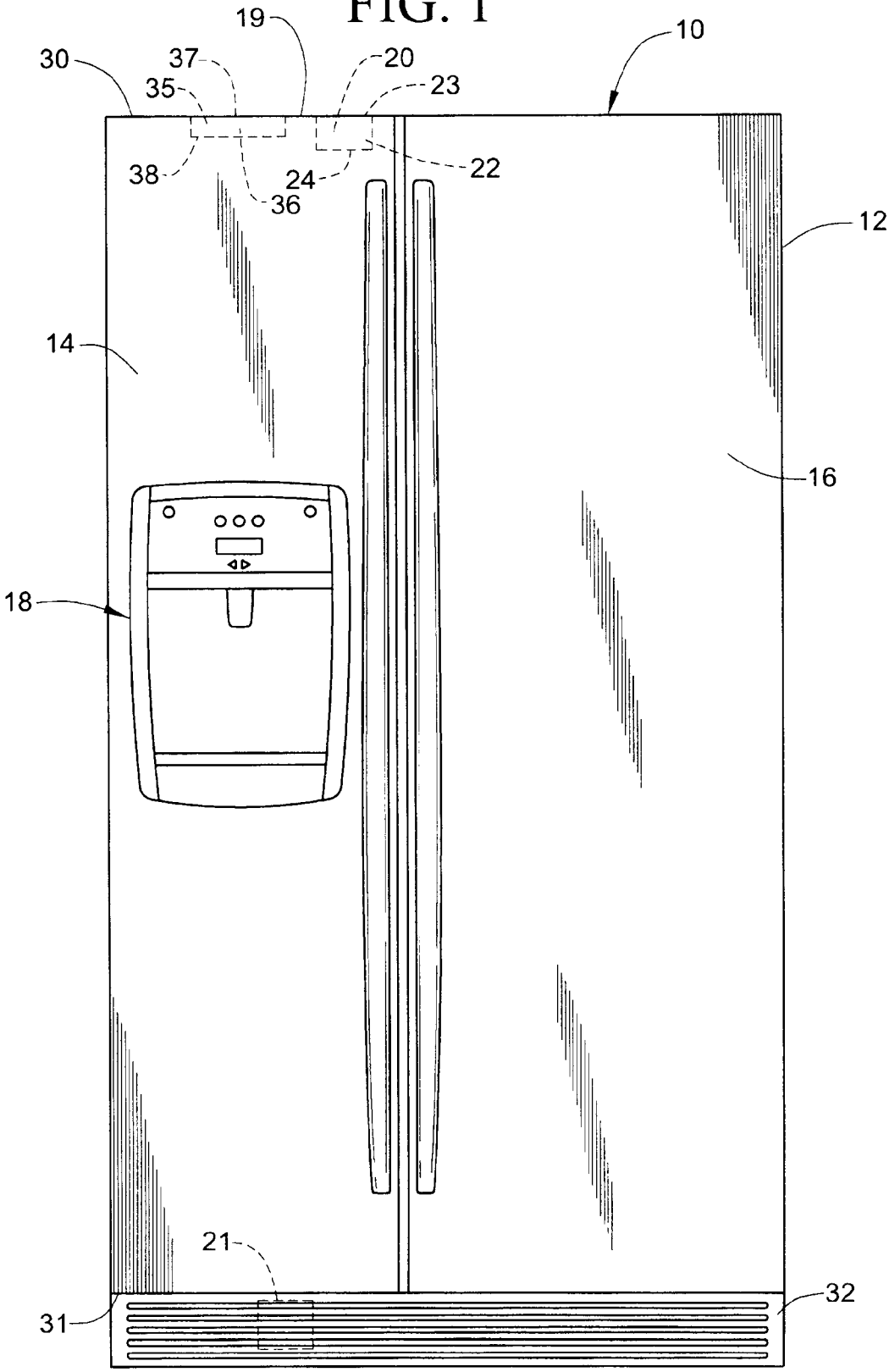
FIG. 1 is a perspective view of a side-by-side refrigerator incorporating the plug-in power supply arrangement of the invention.

With initial reference to FIG. 1, a refrigerator 10 includes a cabinet or shell 12 having a freezer door 14 and a fresh food door 16 pivotally mounted thereto. In a manner known in the art, a fresh food compartment (not shown) can be accessed by the selective opening of fresh food door 16. In a similar manner, freezer door 14 can be opened to access a freezer compartment (not shown). In the embodiment shown, freezer door 14 includes a dispensing unit 18 that enables a consumer to retrieve a water product, such as ice and/or fresh water, without opening freezer or fresh food doors 14, 16. In a manner known in the art, electrical and water supply lines are routed to dispensing unit 18 through at least one of the hinge regions (not labeled) for freezer door 14. At this point, it should be understood that, although the invention is being described with reference to the side-by-side refrigerator 10 shown in FIG. 1, the invention can be employed in various types and models of refrigerators including, but not limited to, top mount, bottom mount and French door style refrigerators. Instead, the invention is particularly concerned with the incorporation of a plug-in power supply 19 having an connector cup 35 and an auxiliary power supply compartment 20 in a refrigerator, such as refrigerator 10, as will be detailed below.

As generically illustrated in FIG. 1, auxiliary power supply compartment 20 includes a recessed area 22, a top portion 23 and a bottom portion 24. Connector cup 35 also includes a recessed area 36, a top portion 37 and a bottom portion 38. At this point, it should be noted that the particular position of one or more portions of plug-in power supply 19 can vary in accordance with the invention. For instance, auxiliary power supply compartment 21 can be substituted for auxiliary power supply compartment 20. More specifically, as shown in FIG. 1, auxiliary power supply compartment 20 is located in a top portion 30 of freezer door 14, while auxiliary power supply compartment 21 is located behind a removable grill 32 of refrigerator 10. While auxiliary power supply compartments 20, 21 are shown in specific locations, the particular location(s) selected can vary such that auxiliary power supply compartment 20 or 21 may be mounted in any location in refrigerator 10. As auxiliary power supply compartments 20 and 21 perform the same function, only one auxiliary power supply compartment is actually needed for each connector cup 35 will be discussed in further detail below.

Figure 2:
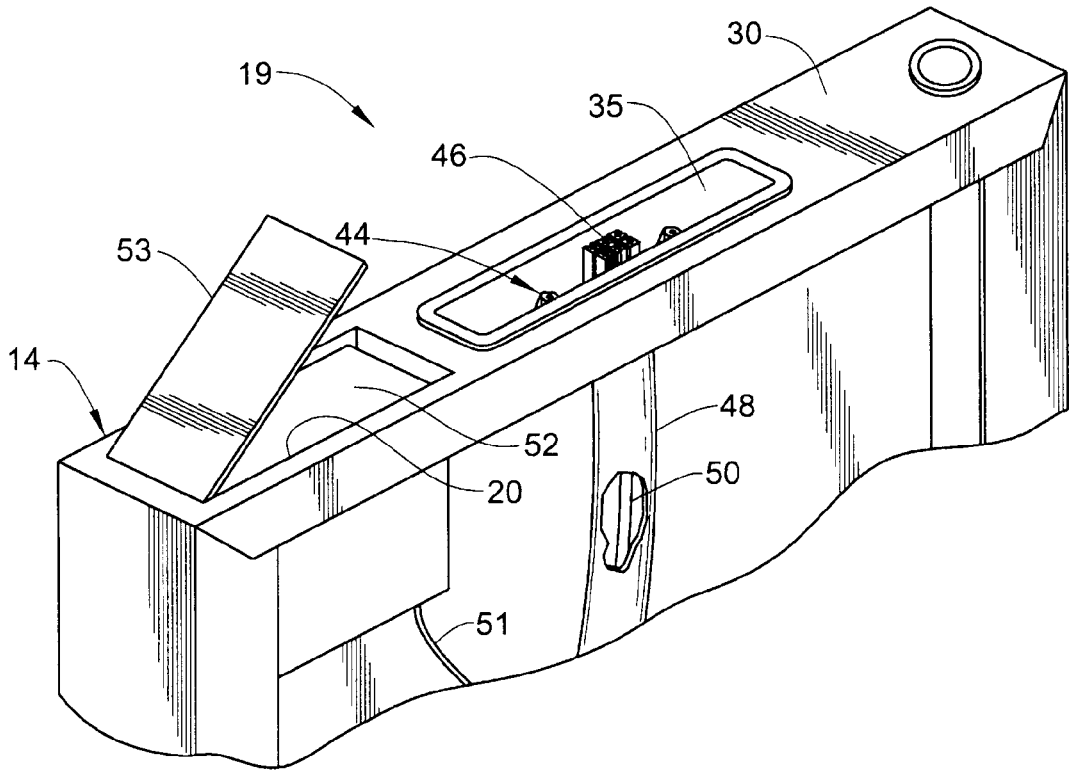
FIG. 2 is an enlarged view of a top portion of one door employed in the refrigerator of FIG. 1.

In the embodiment shown in FIG. 2, connector cup 35 is generally recessed within top portion 30, as opposed to bottom portion 31, of freezer door 14. In this manner, connector cup 35 is upwardly exposed. As also shown in FIG. 2, mounted in connector cup 35 is a removable module 44 having an electrical connector 46. Extending from beneath connector cup 35, within freezer door 14, is a conduit 48 having sleeved wires 50 located therein. Wires 50 are connected to wires 51 to provide power from a removable power supply 52, which is positioned in recessed area 22 of auxiliary power supply compartment 20, to electrical connector 46. Preferably, power supply 52, which could constitute a rechargeable battery or a transformer electronically linked to a main power module (not shown) of refrigerator 10, is arranged below a cover 53 used to hide power supply 52 within auxiliary power supply compartment 20. In the most preferred form of the invention, cover 53 is electrically linked through a switch (not shown) to wires 51 of power supply 52 such that, when cover 53 is opened, power supply 52 is electrically disconnected from electrical connector 46.

Figure 3:
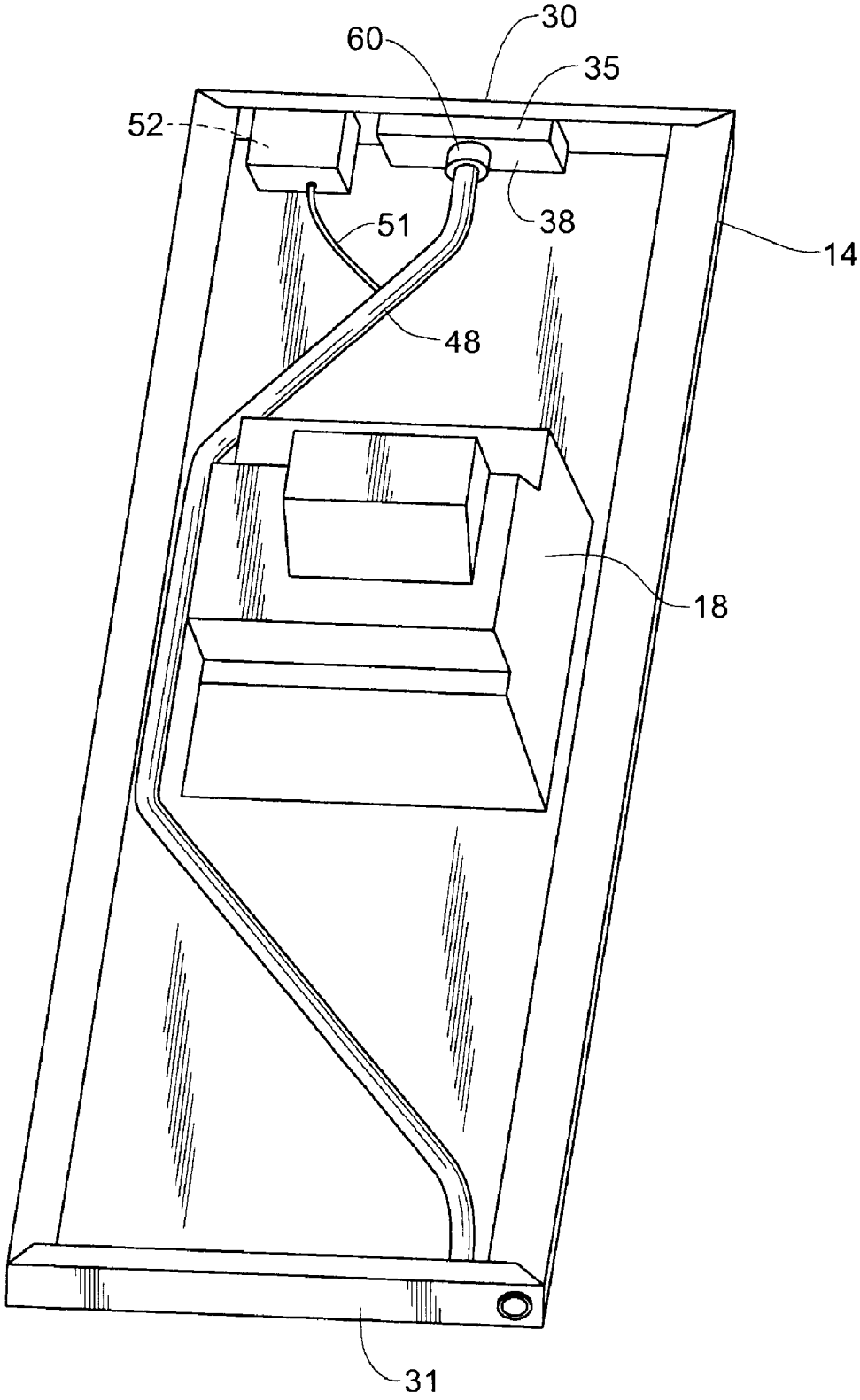
FIG. 3 is a rear perspective view of the refrigerator door of FIG. 2.

As can be seen in FIG. 3, a drain 60, located at bottom portion 38 of connector cup 35, couples conduit 48 to connector cup 35. Drain 60 provides a passage that actually guides any water which may enter into connector cup 35 away from electrical connector 46. As illustrated, conduit 48 guides water from top portion 30 of freezer door 14 to bottom portion 31 of freezer door 14 and preferably into a dispenser well (not shown) behind grill 32. It is also contemplated that drain 60 can be provided as a separate entity that leads to bottom portion 31 of freezer door 14, instead of being attached to conduit 48.

Figure 4:
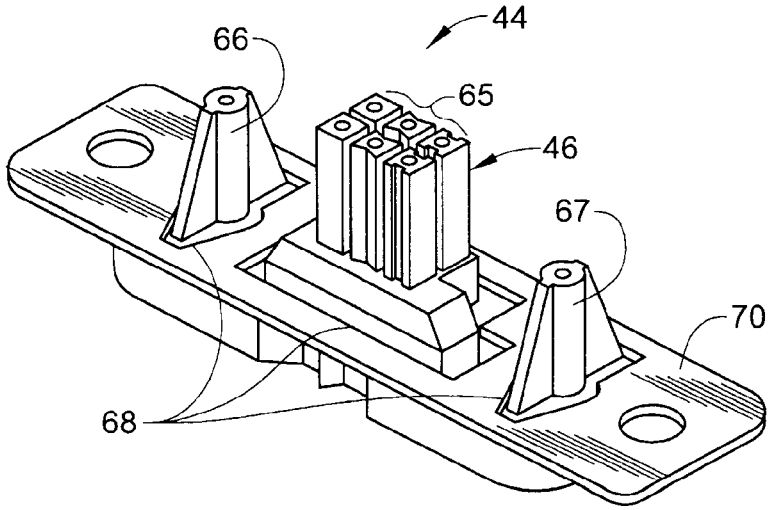
FIG. 4 is a perspective view of a connector mounting arrangement employed in accordance with a preferred embodiment of the invention.

An enlarged view of an exemplary module 44 is shown in FIG. 4. At this point it should be realized that module 44 is selected for use with a particular portable electronic device.

Therefore, the particular configuration and design of module 44 can vary depending on the particular electronic device to be electrically connected to plug-in power supply 19. As shown, electrical connector 46 of module 44 includes a pin array 65. Pin array 65 allows electrical connector 46 to connect to devices having different voltages. For example, 12V, 15V and 24V. Again, while pin array 65 is shown in conjunction with electrical connector 44, any suitable electrical connection means known in the art may be used. In any case, the design of module 44 allows removable power supply 52 to be of the type that provides a high power rating. Alternatively, multiple removable power supplies 52 could be used in conjunction with a common module 44.

In the embodiment illustrated, electrical connector 46, as well as mounting posts 66 and 67 provided for mounting any particular electronic unit base to module 44, protrudes through enlarged holes 68 of a mounting plate 70 used to attach electrical connector 46 to connector cup 35. Enlarged holes 68 are large enough to allow electrical connector 46 to float in relation to connector cup 35. More particularly, FIG. 4 clearly shows some play or gap tolerances between electrical connector 46 and mounting plate 70 at holes 68 which eases attachment of an electrical device to electrical connector 46 while also preventing the bending of pin array 65.

Figure 5:
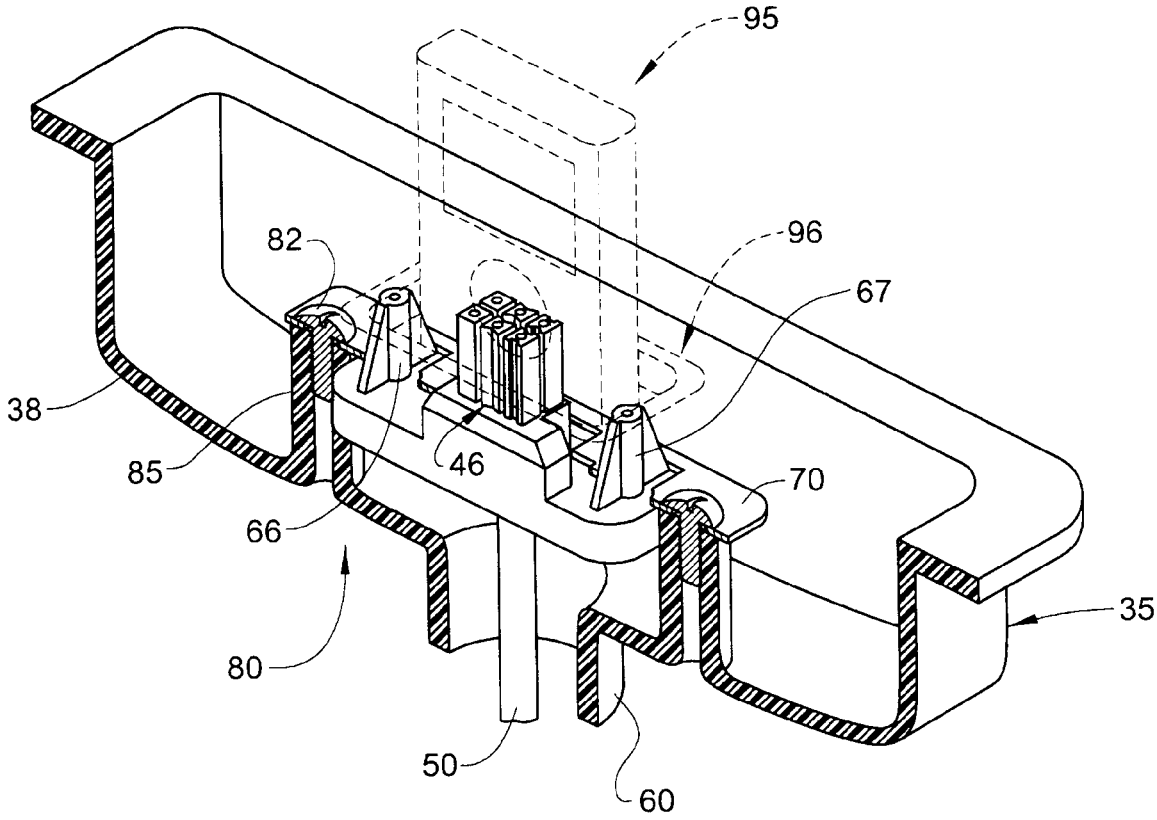
FIG. 5 is an enlarged, partial cross-sectional view detailing a connector module and cup arrangement in accordance with one preferred connector arrangement of the invention.

One embodiment of removable module 44 mounted above bottom portion 38 of connector cup 35 and providing a passage for draining connector cup 35 of any entering liquids is shown in FIG. 5. Again, module 44 has associated therewith a mounting plate 70 for securing module 44 in connector cup 35 with electrical connector 46 projecting through mounting plate 70 and being recessed within connector cup 35. As illustrated, mounting plate 70 is secured to a central, raised portion 80 of connector cup 35 such as, for example, mechanical fasteners 82 extending into raised central mounting posts 85 of connector cup 35. Preferably, connector cup 35 is integrally molded of plastic and includes a lower drain opening (not labeled) for the attachment of conduit 48. Although separate electrical and drain conduits could be provided, FIGS. 2 and 5 illustrates conduit 48 which serves as both a drain conduit and a conduit for the wires 50 routed to electrical connector 46.

In order to utilize and/or charge a particular portable electronic device through plug-in power supply 19, a module 44 configured for use with the portable electronic device is selected. Although not intended to be limiting, the invention can be advantageously used to enable a variety of portable electronic devices, including cell phones, personal music players like iPods, as well as digital picture frames, Web tablets, message boards, TV's, CD and/or DVD players, and the like to be electrically connected to and powered through refrigerator 10. Depending on the particular device, a corresponding module 44 and power supply 52 would be employed such that a user could just insert the portable electronic device into connector cup 35, thereby coupling electrical connector 46 with the portable electronic device. Power, provided by power supply 52 through wires 50 and 51, would then charge the portable electronic device, when cover 53 is closed, and/or enable the electronic device to be utilized while attached.

Based on the above, it should be readily apparent that the present invention is directed to expanding the ability of individuals to conveniently power portable electronic devices from different locations. More specifically, the invention is concerned with providing an auxiliary power connector unit on a refrigerator to enable a variety of portable electronic devices, such as the exemplary portable music storing/playing device 95 in a base 96 secured to mounting posts 66 and 67 as to be electrically connected to and powered through the refrigerator. In further accordance with the invention, dedicated modules are made available and can be readily replaceably mounted in a connector cup, with each module have one common connector side for interconnecting the connector with an auxiliary power supply and an exposed, dedicated connector side for selective attachment to the portable electronic device(s). As different portable electronic devices will have different voltage and power requirements, each replaceable module would have a related auxiliary power supply which can also be replaced. By maintaining the connector module above a bottom of the cup and providing a passage for draining the cup of any entering liquids, the electrical connections are well protected. To enhance the ease of which one or more portable electronic devices can be connected at the module and to prevent undesirable damage to the pins or other connectors of the module, the connector is designed to be shiftable or float relative to the connector cup. In any case, the present invention enables a wide range of portable electronic devices to be directed attached to and powered through a refrigerator such that the refrigerator can now be used as a charging location, a hands-free cell phone speaking station, a music station and the like.

Although described with reference to preferred embodiments of the invention, it should be readily understood that various changes and/or modifications can be made to the invention without departing from the spirit thereof. In general, the invention is only intended to be limited by the scope of the following claims.

What is claimed is:

1. A refrigerator comprising:

a cabinet within which is defined a refrigeration compartment;

a door movably mounted to the cabinet for selectively accessing the refrigeration compartment; and a plug-in power supply for use in electronically attaching a portable electronic device to the refrigerator, said plug-in power supply including an auxiliary power supply, a connector cup having a recessed zone provided with a drain for removing liquids from the recessed zone, and an electrical module mounted in the connector cup, said electrical module including an electrical connector electrically connected to the auxiliary power supply, wherein a portable electronic device can be attached to the electrical connector in order to be electrically connected to the auxiliary power supply and powered through the refrigerator.

2. The refrigerator according to claim 1, wherein the electrical connector includes an array of pins, allowing the electrical connector to connect to electronic devices having different voltages.

3. The refrigerator according to claim 1, wherein the door includes a top portion and the plug-in power supply is provided at the top portion of the door.

4. The refrigerator according to claim 1, further comprising: a conduit extending from the drain and wires electrically coupling the electrical connector to the auxiliary power supply, wherein the wires extend through at least a portion of the conduit.

5. The refrigerator according to claim 1, further comprising: an auxiliary power supply compartment having a recessed area in which the auxiliary power supply is removably located.

6. The refrigerator according to claim 5, further comprising: a cover extending over the recessed area of the auxiliary power supply compartment, wherein power is cut off to the electrical connector when the cover is open.

7. The refrigerator according to claim 1, wherein the connector cup includes a raised central portion, said electrical module being mounted in the connector cup at the raised central portion, wherein the electrical module is arranged above the drain.

8. The refrigerator according to claim 7, further comprising a mounting plate for attaching the electrical module in the connector cup, with the electrical connector projecting through the mounting plate.

9. The refrigerator according to claim 8, wherein the electrical connector is mounted so as to float relative to the connector cup.

10. In a refrigerator comprising a cabinet within which is defined a refrigeration compartment and a door mounted to the cabinet for selectively accessing the refrigeration compartment, a method of operating a portable electronic device comprising:

removably inserting a portable electronic device into an electrical connector positioned in a connector cup mounted on the refrigerator;

electrically interconnecting the portable electronic device to an auxiliary power supply of the refrigerator through the electrical connector; and providing liquid drainage for the connector cup.

11. The method of claim 10, further comprising: electrically interconnecting the electrical connector and the auxiliary power supply through structure associated with the liquid drainage.

12. The method of claim 10, further comprising: mounting the portable electronic device to a raised central portion of the connector cup above the drain.

13. The method of claim 10, further comprising: powering electronic devices having different voltage requirements with the electrical connector.

14. The method of claim 10, wherein the electronic device is positioned in the recessed area of the auxiliary power supply compartment door at a top portion of the door of the refrigerator.

15. The method of claim 10, wherein liquid drainage for the connector cup is provided through a conduit extending from a drain of the connector cup and wherein wires electrically coupling the electrical connector to the auxiliary power supply extend through at least a portion of the conduit.

16. The method of claim 10, further comprising: attaching the electrical module in the connector cup with a mounting plate, with the electrical connector projecting through the mounting plate.

17. The method of claim 16, further comprising: shifting the electrical connector relative to the connector cup upon electrically interconnecting the portable electronic device to the auxiliary power supply of the refrigerator through the electrical connector.

18. The method of claim 10, further comprising: removably positioning the auxiliary power supply in a recessed area of an auxiliary power supply compartment.

19. The method of claim 18, further comprising:

positioning a movable cover over the recessed area of the auxiliary power supply compartment; and cutting off power to the electrical connector when the cover is opened.

* * * * *